US010714835B2

(12) United States Patent
Yu et al.

(10) Patent No.: US 10,714,835 B2
(45) Date of Patent: Jul. 14, 2020

(54) ANTENNA AND AN ANTENNA PACKAGING STRUCTURE

(71) Applicant: SPEED WIRELESS TECHNOLOGY INC., San Jose, CA (US)

(72) Inventors: Bin Yu, Suzhou (CN); Qingfang Li, Suzhou (TW); Yanmei Shi, Suzhou (CN)

(73) Assignees: SPEEDLINK TECHNOLOGY INC., Cupertino, CA (US); HUIZHOU SPEED WIRELESS TECHNOLOGY CO., LTD, Guangdong (CN)

( * ) Notice: Subject to any disclaimer, the term of this patent is extended or adjusted under 35 U.S.C. 154(b) by 71 days.

(21) Appl. No.: 15/726,348

(22) Filed: Oct. 5, 2017

(65) Prior Publication Data

US 2018/0342810 A1 Nov. 29, 2018

(30) Foreign Application Priority Data

May 26, 2017 (CN) ..... 2017 1 0385094

(51) Int. Cl.

| | |
|---|---|
| ***H01Q 1/48*** | (2006.01) |
| ***H01Q 13/10*** | (2006.01) |
| ***H01Q 1/50*** | (2006.01) |
| ***H01Q 13/18*** | (2006.01) |
| ***H01Q 19/09*** | (2006.01) |
| ***H01Q 15/00*** | (2006.01) |
| *H01P 3/08* | (2006.01) |
| *H01P 3/02* | (2006.01) |

(52) U.S. Cl.

CPC ..... *H01Q 13/106* (2013.01); *H01Q 1/48* (2013.01); *H01Q 1/50* (2013.01); *H01Q 13/18* (2013.01); *H01Q 15/006* (2013.01); *H01Q 15/008* (2013.01); *H01Q 19/09* (2013.01); *H01P 3/026* (2013.01); *H01P 3/08* (2013.01); *H01P 3/081* (2013.01)

(58) Field of Classification Search

CPC ..... H01Q 13/106; H01Q 1/48; H01Q 1/50

See application file for complete search history.

*Primary Examiner* — Graham P Smith

(74) *Attorney, Agent, or Firm* — Womble Bond Dickinson (US) LLP

(57) ABSTRACT

An antenna element includes an antenna radiator, an antenna dielectric substrate, a grounded metal plate, and a feed structure. The antenna radiator consists of several metal sheet units. The coupled slots between the adjacent metal sheet units form radiation slots and the grounded metal plate has a feed slot which is fed by the feed structure and the radiation slot is fed by the feed slot through coupling. This disclosure also provides an antenna packaging structure. An EBG is deployed as part of the radiator to improve the problems of high profile and narrow bandwidth of the traditional antennas. The EBG radiator also achieves low profile, broadband and high gain characteristics that is very suitable for millimeter wave band AiP and is also suitable for mass production at low cost, and therefore it can be widely used in 60 GHz WiFi system and a 5G millimeter wave communication system.

20 Claims, 12 Drawing Sheets

ANTENNA AND AN ANTENNA PACKAGING STRUCTURE

RELATED APPLICATIONS

This application claims the priority of Chinese patent application No. 201710385094.2, filed May 26, 2017, which is incorporated by reference in its entirety.

FIELD OF THE DISCLOSURE

This disclosure relates generally to the technical field of wireless communications. More specifically, this disclosure relates to an antenna and an antenna packaging structure.

BACKGROUND

In recent years, the demand for the data transmission rate of a wireless communication system is higher and higher with the development of mobile communication, so the wider bandwidth of the communication system is needed to meet the requirements of the applications. As the most frontend hardware of the communication system, a broadband antenna is essential. There have been many ways of realizing broadband antennas, such as antenna loading, frequency-independent antenna, travelling-wave antenna, multimode technology, broadband feed network, and so on. For an antenna of a millimeter-wave band, an AiP (Antenna in Package) solution is normally adopted, considering the loss of the transmission line in this band.

The current chip packaging technology is moving rapidly towards miniaturization and high integration. So if an antenna is designed in the chip packaging, it must have characteristics of broadband, high gain, and low profile. But the aforementioned traditional antenna structures are difficult to meet these requirements, even with the use of an electromagnetic band-gap (EBG) structure as the reflector or the ground of the antenna to reduce the profile of the antenna. For example, the height of the microstrip antenna will decrease when the ground of microstrip antenna uses EBG structure, but the working mode of the microstrip antenna is still only TM10 mode and therefore the bandwidth of the antenna keeps the same. In addition, the microstrip antenna gain will be slightly enhanced by inhibiting the surface waves.

SUMMARY

In order to solve the above technical problems, the present invention provides a new type of antenna element, which includes an antenna radiator, an antenna dielectric substrate, a grounded metal plate, and a feed structure, and these antenna components are connected successively. The antenna radiator consists of several metal sheet units. Coupling slots between the adjacent metal sheet units form radiation slots. The ground metal plate includes a feed slot, which is fed by the feed structure. The radiation slot is fed by the feed slot through coupling. The slots formed between adjacent metal sheet units will produce an electromagnetic radiation. The TM20 mode and TM10 mode will be excited simultaneously to improve the antenna bandwidth.

In addition, a periodic metal structure disposed on an antenna dielectric substrate helps to form a high impedance surface, which can reduce the thickness of the substrate significantly and achieve an extremely low profile effect due to its zero-reflection phase property. Moreover, the antenna element has a high gain characteristic due to its large size.

The center of the feed slot in the ground metal plate and the center of radiation slot in the center of the periodical metal sheet units coincide. So the amount of coupling between the two can be adjusted to the maximum by tuning the length and width of the feed slot, and it can further improve the bandwidth of the antenna element.

Furthermore, the feed structure includes a feeder line. Once the slots between the adjacent metal sheet units are perpendicular to the feeder line, the slots are referred to as radiation slots. Once the slots between the adjacent metal sheet units are parallel to the feeder line, the slots are referred to as non-radiation slots. Both the number of radiation slots and non-radiation slots should be equal to or larger than 2, which can excite the TM10 mode and TM20 mode simultaneously more easily.

Further, shapes of metal sheet units are one or more of a triangle, a quadrilateral, a hexagon, and a circle. Those triangle, quadrilateral, hexagon are generalized triangle, quadrilateral, and hexagon, which consist of straight edges or curved edges. Further, the metal sheet units are arranged periodically which helps to form a high impedance surface and it can reduce the thickness of the antenna profile. Further, the shape of the feed slot can be configured according to the shape of the radiation slot, such as a W shape, a circle shape, a ring shape, an H shape, a bar shape, or a V shape. The shape of the feed slot can be configured according to the shape of the radiation slot as long as the coupling feed can be realized.

Further, there are metal vias which connect the center of the metal sheet units and the grounded metal plate. The radiation slot and the metal vias form an equivalent parallel capacitance and an equivalent series inductance between each metal sheet unit, which can produce a broadband characteristic in a particular frequency band. Further, the metal sheet unit is a metal patch. The metal patch is easy to process and it has low requirements for processing equipment, which is good for mass production. Further, the feed structure includes a microstrip coupled feed structure, a coplanar waveguide coupled feed structure, a stripline coupled feed structure, and/or a substrate integrated waveguide coupled feed structure, and it can also use other existing feed structures.

Further, the microstrip coupled feed structure also includes a feed substrate which is connected with a grounded metal plate. The feeder line is a microstrip feeder line which is printed in another surface of the feed substrate. The microstrip coupled feed structure is one of the structures used in this disclosure. Further, the feed slot is configured to be perpendicular to the microstrip feeder line. The microstrip coupled feed structure is one of the structures used in this disclosure. Further, the shape of the end of the microstrip feeder line is used to match the impedance of the antenna. The impedance matching can be improved by making some simple deformations at the end of microstrip feeder line. For example, the end of microstrip feeder line is gradual changed into a fan shape structure, a triangle structure and so on.

Further, the feed slots are bar shape slots located in the grounded metal plate. The feeder line of coplanar waveguide (CPW) coupled feed structure is CPW feed structure which is formed by two CPW slots located in the grounded metal plate. The ends of the two CPW slots are respectively connected with the two feed slots. The coplanar waveguide coupled feed structure is one of the structures used in this invention. Further, the feed slot is perpendicular to the CPW feeder line. The coplanar waveguide coupled feed structure is one of the structures used in this disclosure.

Further, the grounded metal plate is referred to as a first grounded metal plate. A substrate integrated waveguide (SIW) coupled feed structure includes a feed substrate which is connected with the first grounded metal plate and a second grounded metal plate. The feeder line is a SIW feeder line and the SIW feeder line consists of two rows of metal vias which are with the first grounded metal plate and the second grounded metal plate. The feed slot is located between the two rows of first SIW metal vias. The substrate integrated waveguide coupled feed structure is one of the structures used in this disclosure.

Further, there is a second SIW metal via at the end of the SIW feeder line. The impedance matching of the antenna can be improved by adjusting the position of the second SIW metal via. Further, the shape of the feed sot is a V shape slot. The substrate integrated waveguide coupled feed structure is one of structures used in this disclosure. Further, the feed slot is parallel or perpendicular to the SIW feeder line. The substrate integrated waveguide coupled feed structure is one of structures used in this disclosure. Further, there is a periodic serrated structure in the edges of the antenna radiator. The periodic serrated structure in the edges of the antenna radiator can improve the bandwidth of the antenna.

Further, a direction perpendicular to the feeder line is a non-radiation direction. There are short metal components in the two edges in the non-radiation direction of the antenna radiator. One end of the short metal components is connected with a top surface of the antenna substrate, and the other end of the short metal components is connected with the grounded metal plate. The short metal components can suppress surface waves and optimize the radiation performance of the antenna.

The present invention also provides an antenna packaging structure, which includes a chip die, a main board, a package, and antenna elements as mentioned above. The package, the chip, and the mainboard are sequentially arranged from top to bottom and the antenna elements are located in the package body. The antenna packaging structure is one of structures used in this disclosure.

To improve the problems of a high profile and a narrow bandwidth of traditional antennas, this disclosure uses an EBG structure as the antenna radiator which has low profile, broadband and high gain characteristics and it is very suitable for millimeter wave band AiP. It is very suitable for mass production at low cost, and it can be widely used in 60 GHz WiFi system and 5G millimeter wave communication system in the near future. The following are some of the obvious features and advantages of the present invention.

The antenna element in this disclosure has a very low profile, only with a total antenna thickness of $0.03\times\lambda 0$. This makes it very suitable for application in chip and antenna packaging with very limited space resources at a millimeter wave band, and makes it very suitable for mass production at a low cost, and it can be widely used in a millimeter wave communication system.

The antenna element in this disclosure has a good impedance bandwidth which is very wide. The bandwidth is more than 34% when the thickness of substrate is $0.03\times\lambda 0$, while the bandwidth of traditional microstrip antenna is only about 1~2% with the same thickness of substrate. When applied to millimeter wave communication, it can cover the continuous spectrum resources that are currently divided by governments around the 60 GHz frequency.

The antenna element radiation pattern of the present disclosure is a broadside pattern. The antenna element in this disclosure does not need a clearance area, and it only needs a certain height, which is suitable for mounting in a package body of a chip. The antenna element in this disclosure has a high gain characteristic about 10 dBi, which is suitable for the millimeter wave communication, since the feeder line loss and space transmission loss are very large in this band. The antenna element gain bandwidth in this disclosure is very wide and the antenna element gain is high in the whole impedance bandwidth, which can meet the gain demand of the bands in different countries.

The antenna element in this disclosure is suitable for forming an array antenna, which is very suitable for realizing beamforming and phased array applications in the millimeter wave band in the 5G mobile terminals. The antenna array consists of a group of antenna elements that can transmit signals independently. The beam forming of antenna array is realized by adjusting the amplitude and phase of each antenna element. The antenna element in this disclosure has a simple structure. It is easy to process and needs no complex structures to increase the bandwidth of the antenna (such as loaded cavity, multi-layer structure, the frequency-independent antenna or travelling wave antenna, etc.), and it can achieve mass production by AiP packaging process.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Figure 1:
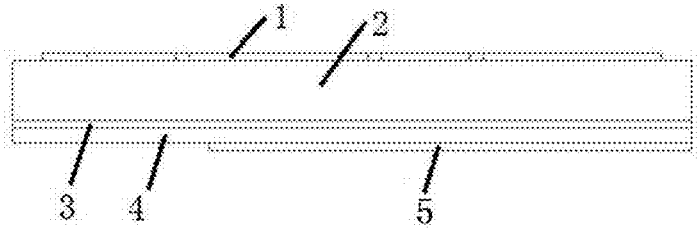
FIG. 1 shows a side view diagram of antenna according to certain embodiments of the invention.

Figures discussed above and the various embodiments used to describe the principles of the present invention in this patent document are by way of illustration only and should not be construed in any way to limit the scope of the invention. Drawings and embodiments are provided so that this invention will be thorough and complete and will fully convey the scope of the invention to those skilled in the art.

With respect to the Figures listed, the antenna radiator is 1, the metal sheet unit is A1, the radiation slot is B1, the non-radiation slot is C1, the metal vias is D1, the seratted structure is E1, the antenna dielectric substrate is 2, the grounded metal plate is 3, the feed slot is A3, the CPW slot is B3, the feed substrate is 4, the feeder line is 5, the first grounded metal plate is 6, the second grounded metal plate is 7, the first SIW metal vias is 8, the second SIW metal vias is 9, the chip die is 10, the mainboard is 11, the cover layer is 12, the first dielectric layer is 13, the first prepag layer is 14, the second dielectric layer is 15, the second prepag layer is 16, the third dielectric layer is 17, the short metal component is 18.

The present invention relates to a low profile, broadband, and high gain antenna. An antenna radiator is arranged periodically by several polygonal metal sheets in the same shape or different shapes and these polygonal metal sheets are coupled with each other. The electromagnetic radiation is generated by one or more slots between adjacent polygonal metal sheets in a non-radiation direction, and the TM10 mode and the TM20 mode are excited simultaneously to achieve a broadband and high gain antenna. Through loading periodic metal structure in the substrate, it can increase the effective permittivity of the substrate. The overall antenna element thickness can be significantly reduced by using a periodic metal structure as a radiator of the antenna. When the antenna height is reduced to $0.03>\lambda 0$, the antenna bandwidth is about 34% and therefore, the antenna element in this disclosure has ultra-low profile, broadband and high gain characteristics.

Embodiments 1-9 of the present invention are all microstrip coupled feed structures, which include an antenna radiator 1, a dielectric substrate 2, a grounded metal plate 3, a feed substrate 4, and a feeder line 5 from top to bottom. The antenna radiator is arranged repeatedly or periodically by several polygonal metal sheets in the same shape or different shapes and these polygonal metal sheets are coupled with each other. The antenna feed structure uses a slot coupled feed structure on the back of the feed substrate. The electromagnetic energy of the microstrip feeder line is coupled to the antenna radiator 1 through the feed slot on the center of grounded metal plate. By adjusting the length of the open stub of the microstrip feeder line, it can improve the impedance matching characteristic. In this type of antenna, several embodiments are presented in FIGS. 1 through 14.

Embodiment 1

Figure 2:
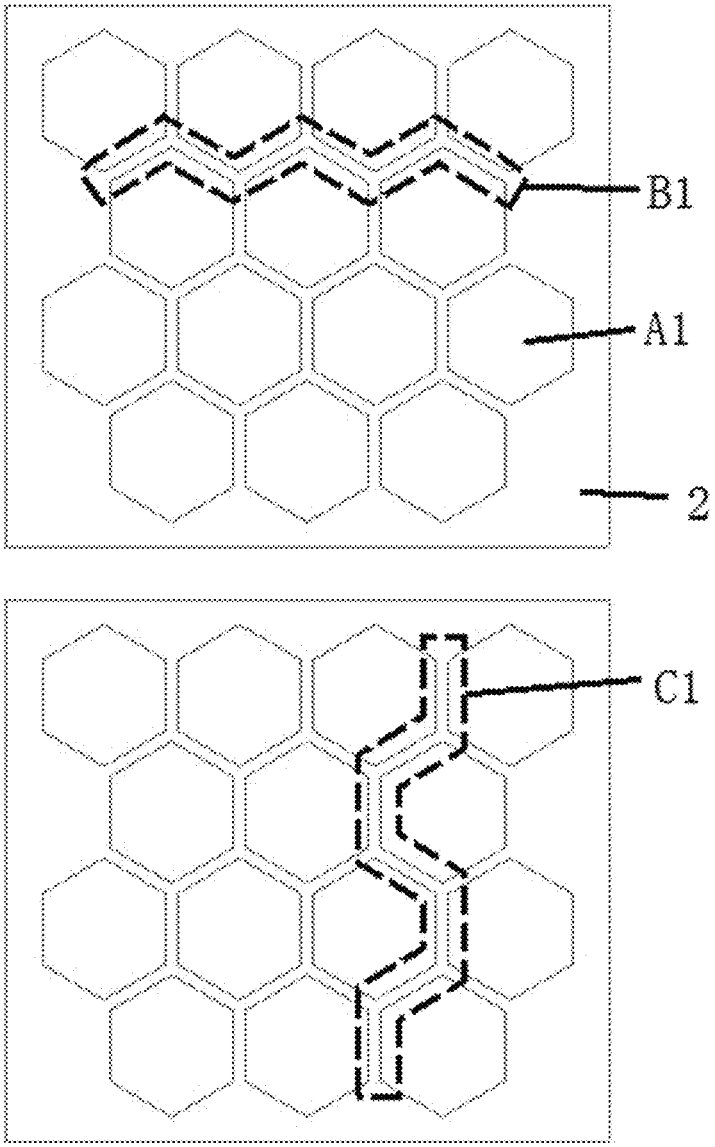
FIG. 2 shows a front view diagram of antenna embodiment 1 of the present invention.
Figure 3:
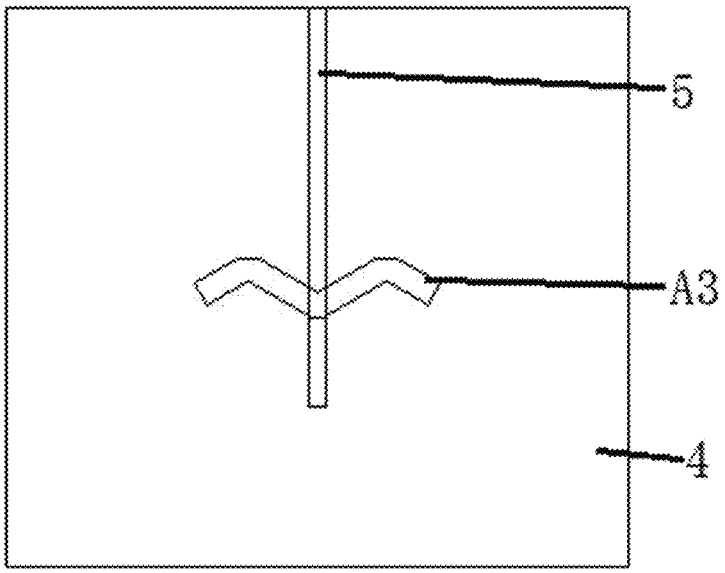
FIG. 3 shows a back view diagram of antenna embodiment 1 of the present invention.

As shown in FIGS. 1-3, an antenna radiator is arranged repetitively or periodically by 14 hexagonal metal sheet units A1. The radiation slots B1 formed by six adjacent hexagonal metal sheet units in a direction of non-radiation and the non-radiation slots C1 formed by six adjacent hexagonal metal sheet units in the direction of radiation form a capacitive loading periodic structure. The antenna bandwidth is improved by adjusting the width of the radiation slots and the non-radiation slots. FIG. 3 shows the back view of the antenna. The antenna feed structure uses a slot coupled feed structure. The electromagnetic energy of the microstrip feeder line is coupled to the antenna radiator through a W shape feed slot at the center of grounded metal plate. The impedance matching characteristic of the antenna element can be improved by adjusting the length of the microstrip feeder line open stub. In addition, the center of the W shape feed slot and the center of radiation slot at the center of the periodical hexagonal metal sheet units coincide with each other. So the amount of coupling between the two can be adjusted to maximum by tuning the length and width of the W shape feed slot, and it can further improve the bandwidth of the antenna.

When the antenna element is working, it will produce electromagnetic radiation from the slots between adjacent hexagonal metal sheet units along a direction of the feeder line. The TM10 mode and the TM20 mode can be excited simultaneously which forms broadband characteristics. The periodic metal structure disposed in the antenna dielectric substrate helps to form a high impedance surface, which can reduce the thickness of the substrate significantly and achieve an extremely low profile effect due to its zero-reflection phase property. The antenna element has a high gain characteristic due to its large size. In addition, the antenna impedance matching characteristic can be improved by adjusting the length of the microstrip open stub. Moreover, the center of the feed slot in the grounded metal plate and the center of the radiation slot in the center of the periodical metal sheet units coincide with each other, so the amount of coupling between the two can be adjusted to the maximum by tuning the length and width of the feed slot. It can further improve the bandwidth of the antenna.

Embodiment 2

Figure 4:
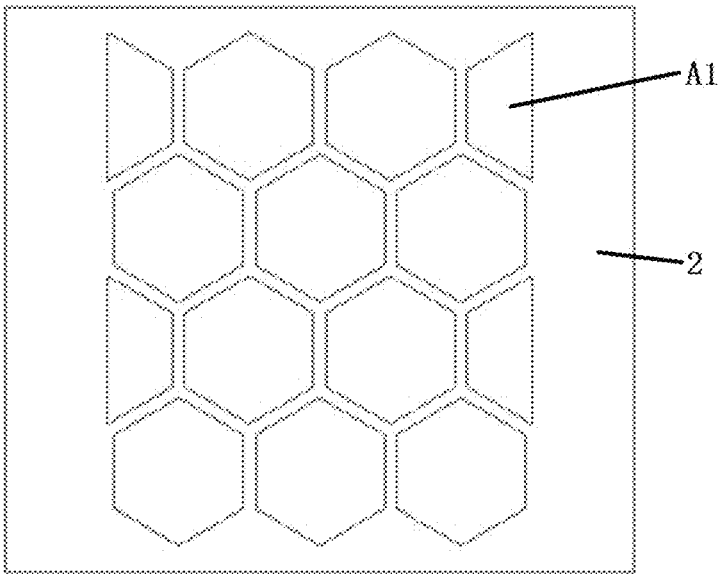
FIG. 4 shows a front view diagram of antenna embodiment 2 of the present invention.

As shown in FIG. 4, this embodiment is similar to the embodiment 1, but the arrangement of the antenna radiator is different. The antenna radiator consists of 10 hexagonal metal sheet units and 4 half hexagonal sheet units. The edge size of the antenna element is reduced in the non-radiation direction when the hexagonal units at the both ends of the non-radiation direction are cut off half.

Embodiment 3

Figure 5:
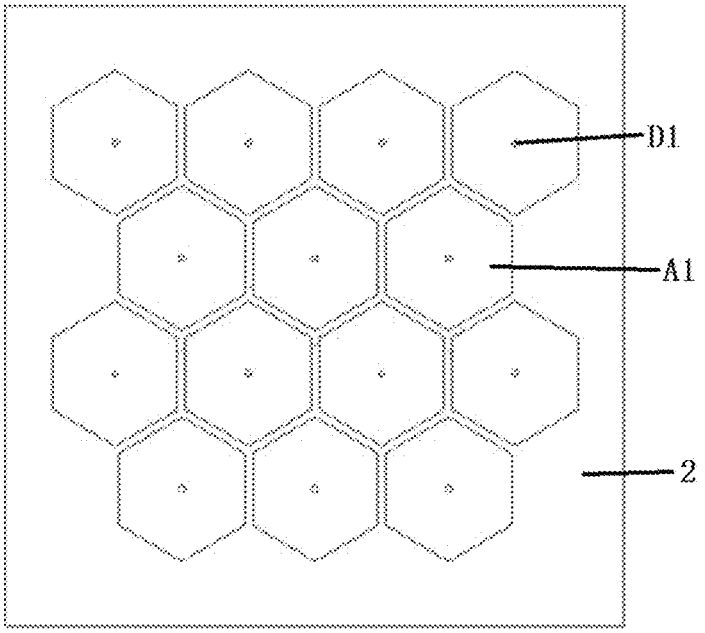
FIG. 5 shows a front view diagram of antenna embodiment 3 of the present invention.

As shown in FIG. 5, this embodiment is similar to embodiment 1. The difference is that the metal vias D1 connected with the grounded metal plate is located at the center of each hexagon metal sheet unit. The radiation slots, the non-radiation slots, and the metal vias form an equivalent parallel capacitance and an equivalent series inductance between each metal sheet unit. The antenna element will produce electromagnetic radiation from the slots between adjacent metal sheet units along the direction of the feeder line, so the TM10 mode and TM20 mode can be excited simultaneously which form a broadband characteristic.

Embodiment 4

Figure 6:
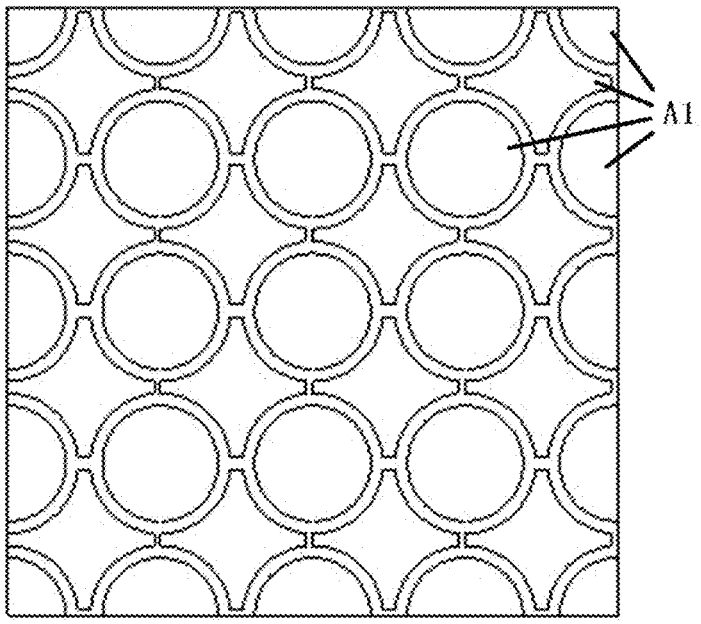
FIG. 6 shows a front view diagram of antenna embodiment 4 of the present invention.
Figure 7:
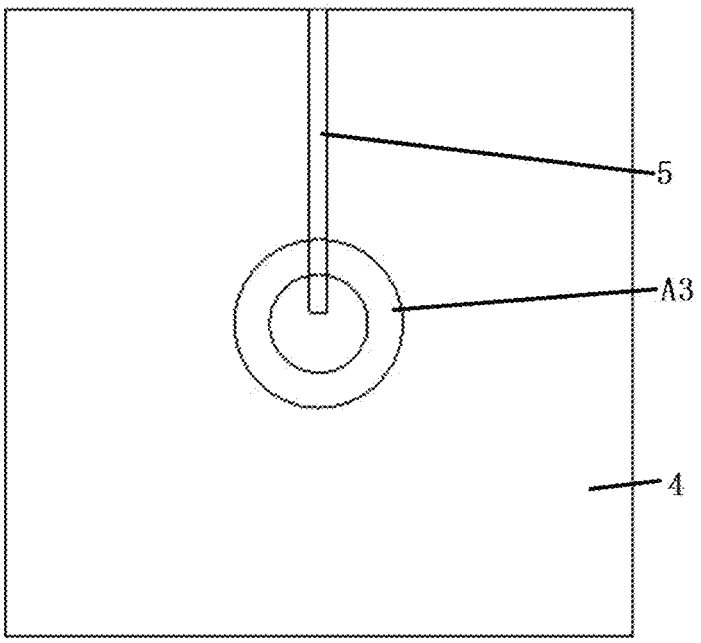
FIG. 7 shows a back view diagram of antenna embodiment 4 of the present invention.

As shown in FIGS. 6-7, the antenna radiator is arranged periodically by 9 circular metal sheet units, 12 semicircular metal sheet units, 4 quarter-circular metal sheet units and 12 rhombic metal sheet units. The central structure of the antenna radiator is a circular shape structure, and the radiation slots between the adjacent circular and rhombic units form a capacitive loading periodic structure. The width of the radiation slot can be adjusted to improve the antenna bandwidth. The antenna feed structure uses a slot coupled feed structure. The electromagnetic energy of the microstrip feeder line is coupled to the antenna radiator through the ring shape feed slot in the center of grounded metal plate. The antenna impedance matching characteristic can be improved by adjusting the length of the microstrip open stub. In addition, the center of the ring shape feed slot in the grounded metal plate and the center of the radiation slot at the center of the periodical metal sheet units coincide with each other, so the amount of coupling between the two can be adjusted to the maximum by tuning the length and width of the feed slot, and it can further improve the bandwidth of the antenna.

Embodiment 5

Figure 8:
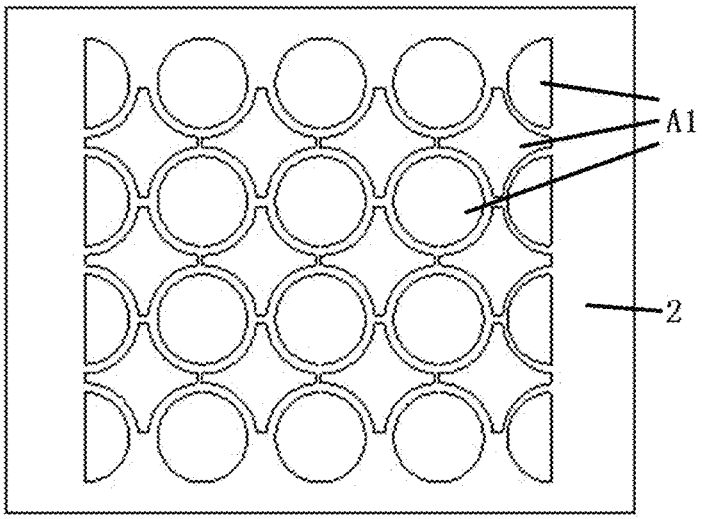
FIG. 8 shows a front view diagram of antenna embodiment 5 of the present invention.

As shown in FIG. 8, this embodiment is similar to embodiment 4. The antenna radiator consists of 12 circular metal sheet units, 8 semicircular metal sheet units, and 16 rhombic metal sheet units. The circular metal sheet units and the rhombic metal sheet units which are mutual cross are arranged to form a periodic structure. The center structure of the antenna radiator is a slot structure, and the width of the slot between the metal sheet units can be adjusted to improve the bandwidth of the antenna.

Embodiment 6

Figure 9:
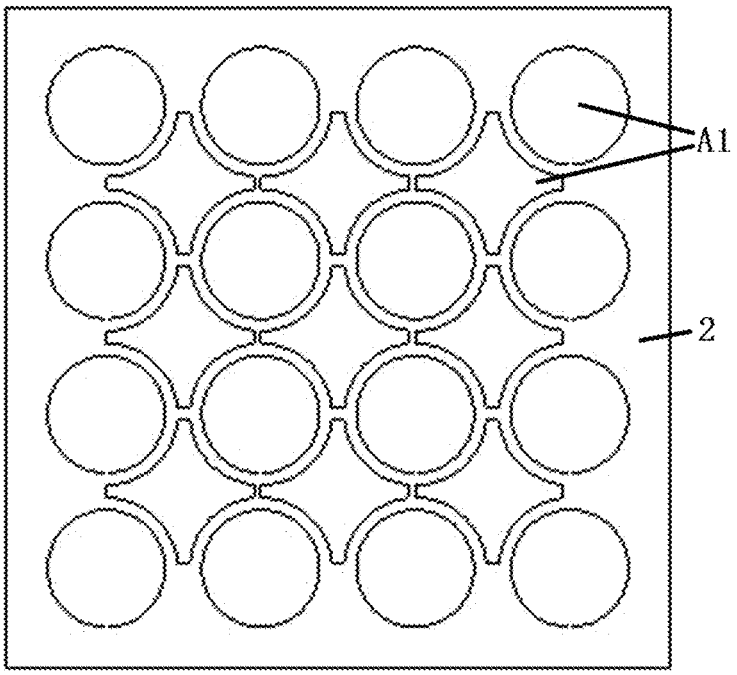
FIG. 9 shows a front view diagram of antenna embodiment 6 of the present invention.

As shown in FIG. 9, this embodiment is similar to embodiment 4. The slot in the grounded plate is a ring shape, and the antenna radiator consists of 16 circular metal sheet units and 9 rhombic metal sheet units. The center structure of the antenna radiator is a rhombic structure, and the width of slot between the metal sheet units can be adjusted to improve the bandwidth of the antenna.

Embodiment 7

Figure 10:
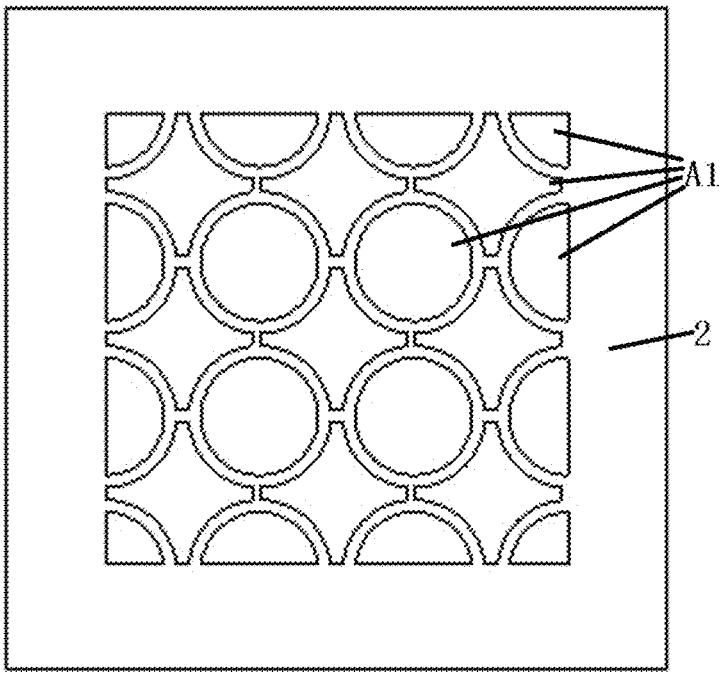
FIG. 10 shows a front view diagram of antenna embodiment 7 of the present invention.

As shown in FIG. 10, this embodiment is similar to embodiment 6, but the circular shape units in the edges of the antenna radiator are cut off half into a semicircular structure.

Embodiment 8

Figure 11:
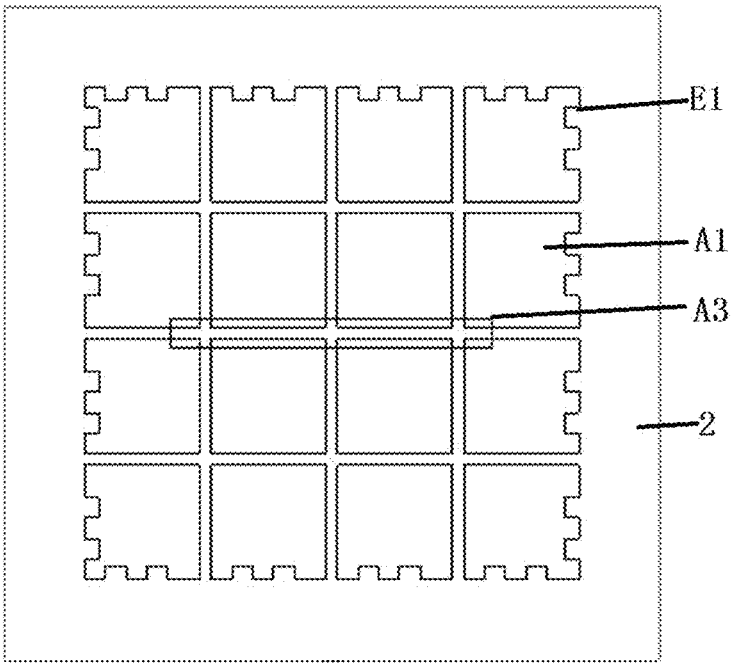
FIG. 11 shows a front view diagram of antenna embodiment 8 of the present invention.
Figure 12:
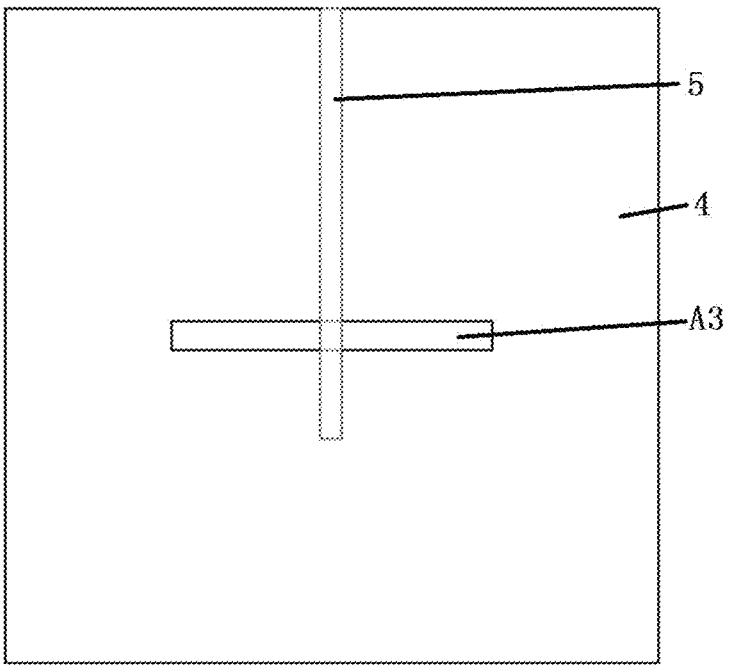
FIG. 12 shows a back view diagram of antenna embodiment 8 of the present invention.

As shown in FIGS. 11 and 12, the antenna radiator is arranged periodically by 16 square shape metal sheet units. The 4 parallel radiation slots are formed by adjacent metal sheet units in the direction of non-radiation and the 4 parallel non-radiating slots are formed by adjacent metal sheet units in the direction of radiation. The periodic serrated structure E1 disposed at the edges of the antenna radiator can improve the bandwidth of the antenna. The radiation slots between adjacent metal sheet units and the non-radiation slots between adjacent metal sheet units form a capacitive loading periodic structure. The antenna bandwidth can be improved by adjusting the width of the radiation slots and the non-radiation slots. The antenna feed structure uses a slot coupled feed structure. The electromagnetic energy of the microstrip feeder line is coupled to the antenna radiator through a bar shape feed slot at the center of grounded metal plate. The antenna impedance matching characteristic can be improved by adjusting the length of the microstrip open stub.

Figure 22:
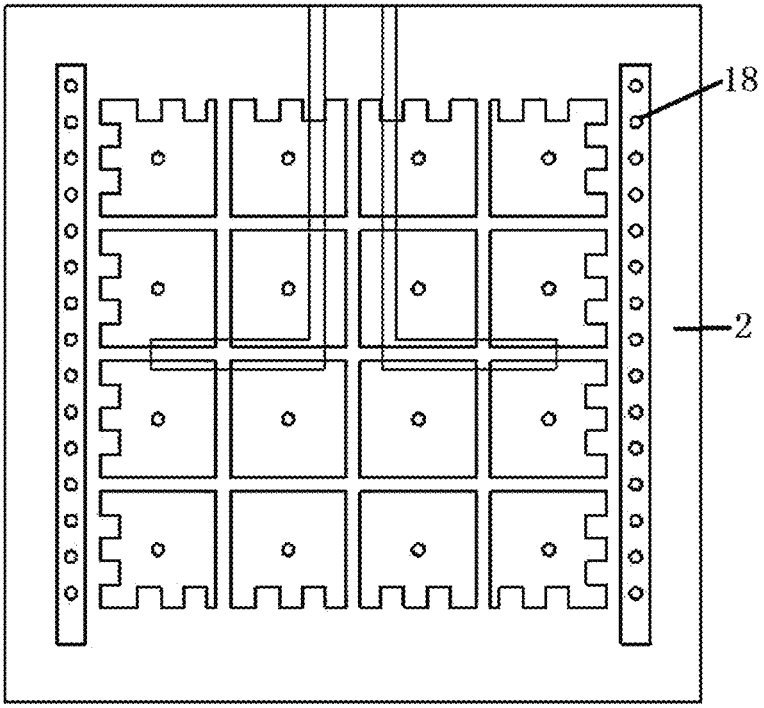
FIG. 22 shows a front view diagram of antenna embodiment 8 of the present invention.

In addition, the center of the bar shape feed slot in the grounded metal plate and the center of the radiation slot in the center of the periodical metal sheet units coincide with each other. As a result, the amount of coupling between the two can be adjusted to the maximum by tuning the width and position of the feed slot, and it can further improve the bandwidth of the antenna. The periodic serrated structure in the edges of the antenna radiator can improve the bandwidth of the antenna. Moreover, the direction perpendicular to the feeder line is a non-radiation direction. There are short metal components 18 at the two edges of the antenna radiator in the non-radiation direction. One end of the short metal components is connected with a top surface of the antenna substrate, and the other end of the short metal components is connected with the grounded metal plate. An embodiment of the short metal components, as shown in FIG. 22, is a row of metal vias connected with the grounded metal plate to suppress the surface waves.

Embodiment 9

Figure 13:
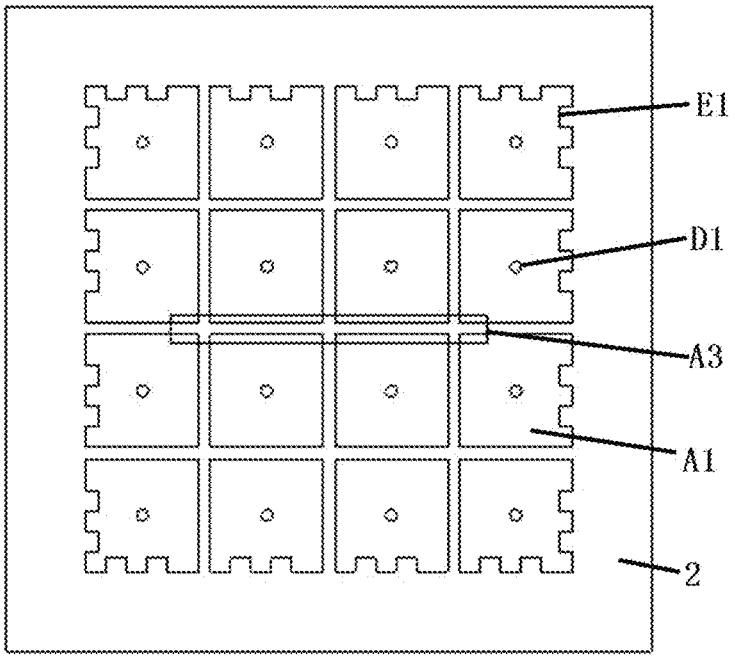
FIG. 13 shows a front view diagram of antenna embodiment 9 of the present invention.

As shown in FIG. 13, this embodiment is similar to embodiment 8. The difference is that metal vias connected with the grounded metal plate is located at the center of each metal sheet unit. The radiation slots, the non-radiation slots, and the metal vias form an equivalent parallel capacitance and an equivalent series inductance between each metal sheet unit. The antenna element will produce electromagnetic radiation from the slots between adjacent metal sheet units along the direction of the feeder line, so the TM10 mode and TM20 mode can be excited simultaneously which form a broadband characteristic.

Embodiment 10

Figure 14:
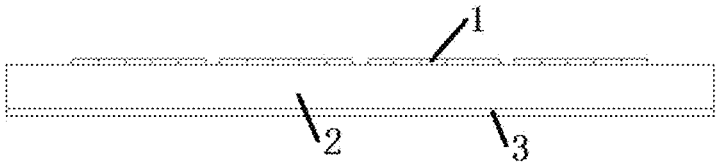
FIG. 14 shows a side view diagram of antenna embodiment 10 of the present invention.
Figure 15:
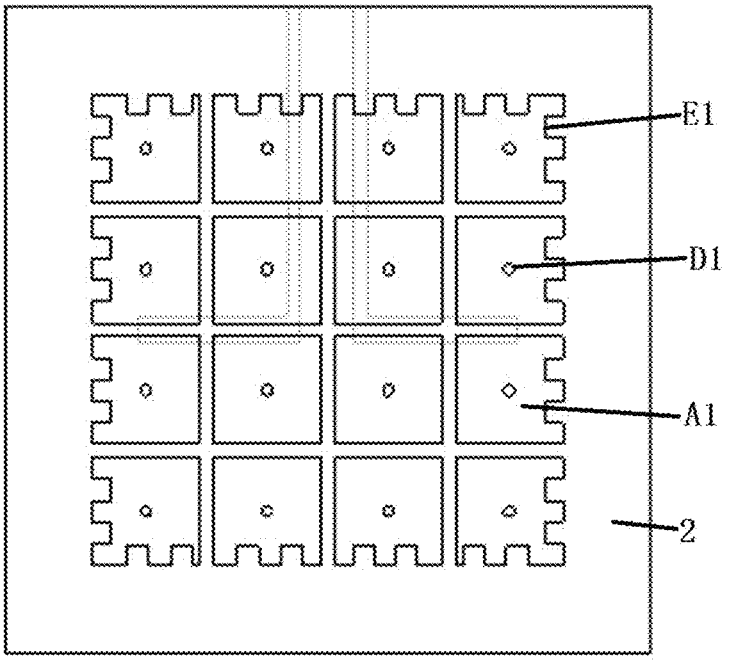
FIG. 15 shows a front view diagram of antenna embodiment 10 of the present invention.
Figure 16:
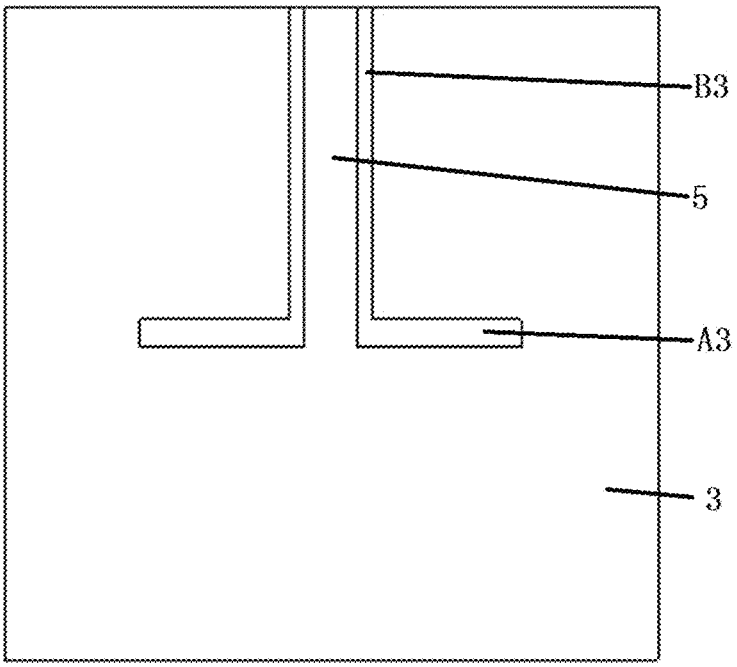
FIG. 16 shows a back view diagram of antenna embodiment 10 of the present invention.
Figure 17:
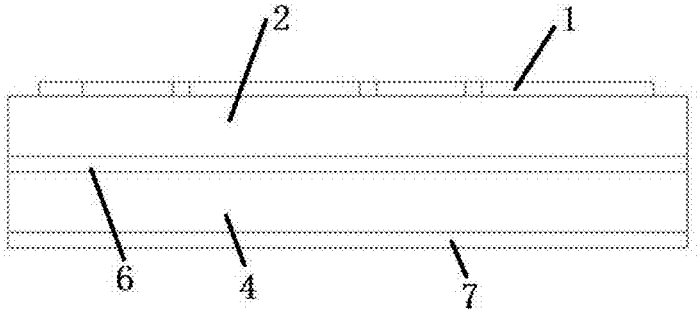
FIG. 17 shows a side view diagram of antenna embodiment 11 of the present invention.

As shown in FIGS. 14-16, the antenna element in this embodiment consists of an antenna radiator, a dielectric substrate, and a grounded metal plate from top to bottom. The antenna radiator in this embodiment is similar to the one in embodiment 9, but the difference is that the antenna feed structure uses a CPW (Coplanar waveguide) coupled feed structure. The feeder line is formed by two CPW slots B3 in the grounded metal plate. The feed slots are two bar shape slots located in the end of the CPW feeder line. The two CPW slots and the two bar shape feed slots form a ][ shape slot (the bar shape feed slot can be perpendicular to the CPW feeder line. The electromagnetic energy of the CPW feeder line is coupled to the antenna radiator through the ][ shape feed slot. In addition, the center of the ][ shape feed slot in the grounded metal plate and the center of radiation slot in the center of the periodical metal sheet units coincide with each other, so the amount of coupling between the two can be adjusted to the maximum by tuning the size of the feed slot, and it can further improve the bandwidth of the antenna.

Embodiment 11

As shown in FIGS. 17-20, the antenna element in this embodiment consists of an antenna radiator, a dielectric substrate, a first grounded metal plate, a feed substrate, and a second grounded metal plate from top to bottom. The antenna radiator in this embodiment is similar to embodiment 2. The antenna feed structure is a SIW (Substrate integrated waveguide) feed structure, which is composed of two rows of first SIW metal vias 8 connected with the first grounded metal plate and the second grounded metal plate, and there are second SIW metal vias 9 at the end of the SIW feeder line. The propagation modes of the substrate integrated waveguide and the characteristic impedance of the SIW transmission line can be adjusted by tuning the diameter of the metal vias, the distance between adjacent metal vias, and the distance between the two rows of metal vias.

Figure 18:
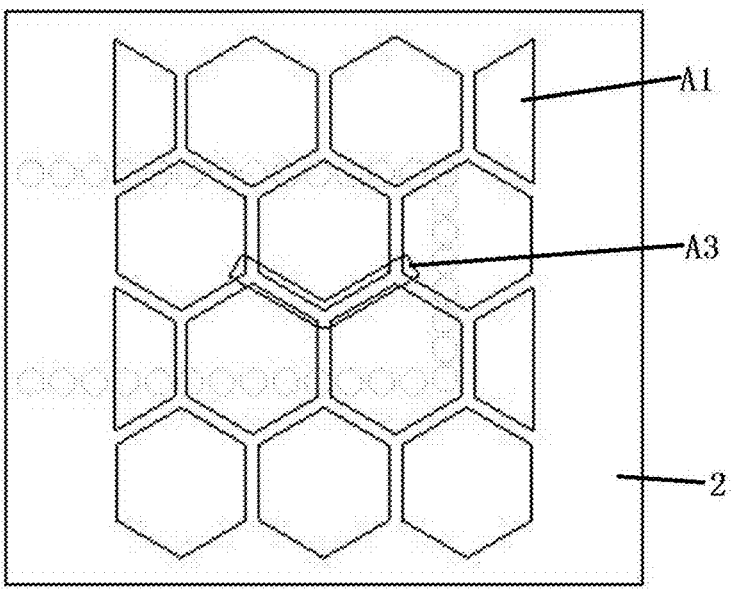
FIG. 18 shows a front view diagram of antenna embodiment 11 of the present invention.
Figure 19:
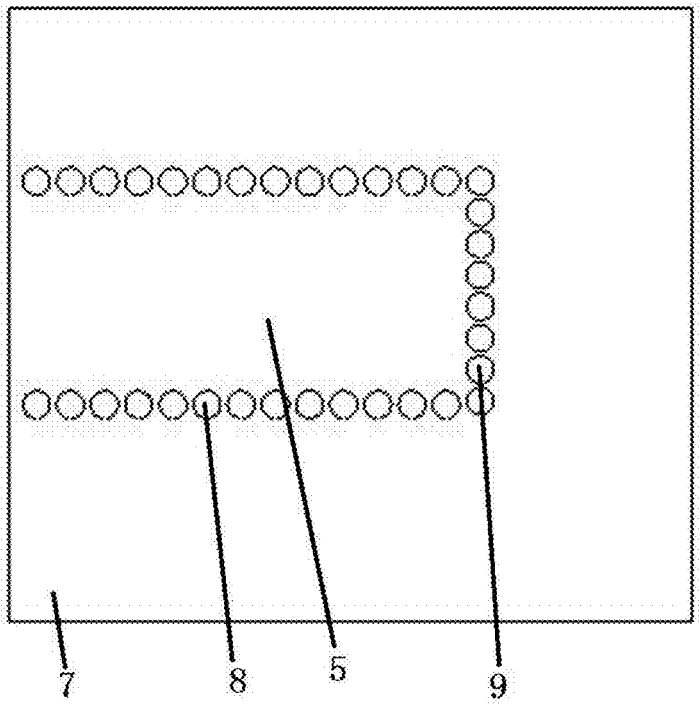
FIG. 19 shows a back view diagram of antenna embodiment 11 of the present invention.
Figure 20:
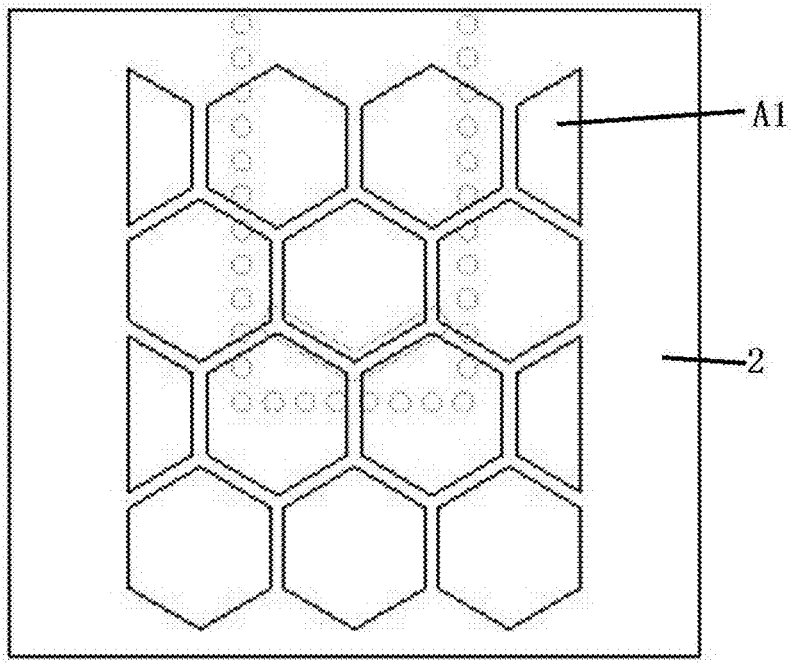
FIG. 20 shows a front view diagram of antenna embodiment 11 of the present invention.

The impedance matching characteristic of the antenna element can be improved by adjusting the position of the second SIW metal vias. The electromagnetic energy of the SIW feeder line is coupled to the antenna radiator through a V shape feed slot at the center of the first grounded metal plate. In addition, the center of the V shape feed slot in the grounded metal plate and the center of radiation slot in the center of the periodical metal sheet units coincide with each other, so the amount of coupling between the two can be adjusted to the maximum by tuning the size of the feed slot, and it can further improve the bandwidth of the antenna. The feed slot can be perpendicular to the SIW feeder line as shown in FIG. 20, or parallel to the SIW feeder line as shown in FIG. 18.

Embodiment 12

Figure 21:
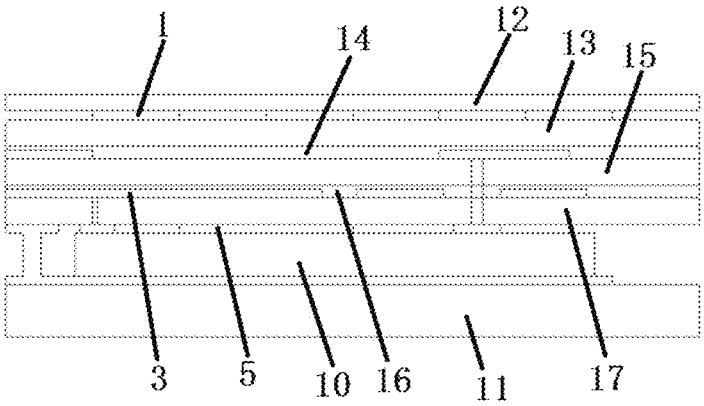
FIG. 21 shows a schematic diagram of an embodiment of the antenna packaging structure of the present invention.

As shown in FIG. 21, the embodiment of antenna packaging structure takes the antenna in embodiment 2 as an example. The antenna packaging structure includes a package, a chip die 10 and a main board 11 from top to bottom. The package is composed of a cover layer 12, a first substrate layer 13, a first prepreg layer 14, a second substrate layer 15, a second prepreg layer 16 and a third substrate layer 17. The antenna radiator is located on the first substrate layer and the grounded metal plate is located on the third substrate layer and the feeder line is located under the third substrate layer. The first substrate layer is the antenna substrate and the third substrate layer is the feed substrate. The cover layer is mainly used to protect the antenna package, while the substrate layer and the prepreg layer are mainly used to place the lead wires of the die. These wires include a power wire, a ground wire and an antenna feeder line, etc., which are used to provide power to the chip and supply all kinds of logical connections. In addition, the substrate layer and the prepreg layer also play a role in protecting and supporting chip.

A detailed illustration has been made about the principles and the implementation methods of the invention combined with the attached drawings above. But the invention should not be construed in any way to limit the scope of the invention. And we can also make all kinds of changes without leaving the purpose of our invention in the range of knowledge that the average technical person in the field possesses.

What is claimed is:

1. An antenna element apparatus, comprising:

an antenna radiator;

an antenna substrate;

a grounded metal plate; and a feed structure, wherein the antenna radiator, the antenna substrate, the grounded metal plate, and the feed structure are connected successively, wherein the antenna radiator includes a plurality of metal sheet units, one or more coupled slots disposed between adjacent metal sheet units to form radiation slots, wherein the grounded metal plate includes a feed slot that is fed by the feed structure, and wherein the radiation slots are fed by the feed slot through coupling.

2. The antenna element apparatus of claim 1, wherein the feed structure includes a feeder line, wherein when the coupled slots between the adjacent metal sheet units are perpendicular to the feeder line, the coupled slots operate as radiation slots, wherein when the coupled slots between the adjacent metal sheet units are parallel to the feeder line, the coupled slot operate as non-radiation slots, and wherein a number of radiation slots and non-radiation slots is equal to or larger than 2.

3. The antenna element apparatus of claim 1, wherein shapes of metal sheet units are one or more of a triangle, a quadrilateral, a hexagon, or a circle.

4. The antenna element apparatus of claim 3, wherein the metal sheet units are arranged periodically.

5. The antenna element apparatus of claim 4, wherein a shape of the feed slot is configured according to a shape of the radiation slot, which is one of a W shape, a circle shape, a ring shape, an H shape, a bar shape, or a V shape.

6. The antenna element apparatus of claim 1, wherein a metal via at a center of each metal sheet unit is connected with the grounded metal plate.

7. The antenna element apparatus of claim 1, wherein each of the metal sheet units includes a metal patch.

8. The antenna element apparatus of claim 1, wherein the feed structure includes a microstrip coupled feed structure, a coupled feed structure, a stripline coupled feed structure, or a substrate integrated waveguide coupled feed structure.

9. The antenna element apparatus of claim 8, wherein the microstrip coupled feed structure includes a feed substrate that is connected with the grounded metal plate, wherein the feeder line is designed in a microstrip line type that is located in another surface of the feed substrate.

10. The antenna element apparatus of claim 9, wherein the feed slot is configured to be perpendicular to the microstrip feeder line.

11. The antenna element apparatus of claim 9, wherein a shape of an end of the microstrip feeder line is used to match an impedance of the antenna element apparatus.

12. The antenna element apparatus of claim 8, wherein the feed slots are bar shape slots located in the grounded metal plate, wherein the feeder line of coplanar waveguide (CPW) coupled feed structure is a CPW feeder line that is formed by two CPW slots located in the grounded metal plate, and wherein ends of the two CPW slots are respectively connected with the two feed slots.

13. The antenna element apparatus of claim 12, wherein the feed slot is configured to be perpendicular to the CPW feeder line.

14. The antenna element apparatus of claim 8, wherein the grounded metal plate is a first grounded metal plate, wherein a substrate integrated waveguide (SIW) feed structure includes a feed substrate that is connected with the first grounded metal plate and a second grounded metal plate, wherein the feeder line is a SIW feed structure and the SIW feeder line includes two rows of metal vias that are connected with the first grounded metal plate and the second grounded metal plate, and wherein the feed slot is located between the two rows of the first SIW metal vias.

15. The antenna element apparatus of claim 14, wherein an end of the SIW feeder line has a second SIW metal via.

16. The antenna element apparatus of claim 14, wherein a shape of the feed slot is a V shape.

17. The antenna element apparatus of claim 16, wherein the feed slot is parallel or perpendicular to the SIW feeder line.

18. The antenna element apparatus of claim 1, wherein there is a periodic serrated structure at edges of the antenna radiator.

19. The antenna element apparatus of claim 2, wherein a direction perpendicular to the feeder line is a non-radiation direction, wherein short metal components are disposed at the two edges in the non-radiation direction of the antenna radiator, wherein one end of the short metal components is connected with a top surface of the antenna substrate and the other end of the short metal components is connected with the grounded metal plate.

20. The antenna element apparatus of claim 1, wherein the antenna element apparatus is packaged in an antenna packaging structure having a chip die, a mainboard, an antenna, and a package, wherein the package, the chip die, and the mainboard are sequentially arranged from top to bottom, wherein the antenna radiator is located in a package body.

* * * * *